United States Patent [19]

Marchesi et al.

[11] 4,273,740

[45] Jun. 16, 1981

[54] PROCESS AND APPARATUS FOR MANUFACTURING SINGLE PIECE RAILROAD TIES OF PRESTRESSED CONCRETE

[75] Inventors: Sergio Marchesi; Gino Fachin, both of Rome, Italy

[73] Assignee: Vianini, S.p.A., Rome, Italy

[21] Appl. No.: 82,481

[22] Filed: Oct. 9, 1979

Related U.S. Application Data

[63] Continuation of Ser. No. 825,557, Aug. 18, 1977, abandoned.

[30] Foreign Application Priority Data

Dec. 30, 1976 [IT] Italy ..... 52836 A/76

[51] Int. Cl.[3] ..... B28B 23/04; B28B 21/78

[52] U.S. Cl. ..... 264/228; 264/333; 264/DIG. 43

[58] Field of Search ..... 264/82, 228, DIG. 43, 264/333; 425/111; 249/86

[56] References Cited

U.S. PATENT DOCUMENTS 3,999,913 12/1976 Branitzky ..... 425/111
4,051,216 9/1977 Bratchell ..... 425/111 X
4,067,939 1/1978 Love ..... 264/DIG. 43

OTHER PUBLICATIONS

Cement Chemistry & Physics for Civil Engineers, Czernin, Crosby Lockwood & Son, Ltd., London, 1962, pp. 54–55.

*Primary Examiner*—Thomas P. Pavelko
*Attorney, Agent, or Firm*—Lyon & Lyon

[57] ABSTRACT

A process and apparatus are disclosed for production casting of railroad ties and the like to obtain maximum mold utility. The casting is accomplished by arranging tendons within a mold and subjecting them to an appropriate tensile stress. Uncured concrete is then introduced at a temperature of around 80° C.–90° C. The mold is vibrated and subsequently closed. It is then maintained at 60° C.–80° C. for a time sufficient to cure the concrete such that the prestressing mechanism can be released. The mold may then be immediately re-used. One mechanism by which the molds may be closed during the curing process in most efficient manner is to employ succeeding molds in a stacked arrangement to cover each preceding mold cavity. A single piece conical locking member is also employed to anchor the tendon in the mold.

2 Claims, 5 Drawing Figures

PROCESS AND APPARATUS FOR MANUFACTURING SINGLE PIECE RAILROAD TIES OF PRESTRESSED CONCRETE

This is a continuation of application Ser. No. 825,557, filed 8/18/77, now abandoned.

BACKGROUND OF THE INVENTION

The present invention is directed to a process for casting railroad ties and the like and for apparatus employed in said process. More specifically, the present invention is directed to the casting of concrete with maximum mold utility.

Conventional wooden railroad ties, for technical and economic reasons, are being progressively replaced by ties made of reinforced concrete. The concrete ties have a longer useful life and make possible higher train speeds. Such concrete ties are generally molded and prestressed.

Prestressing requires that the concrete product remain in the mold during curing. Once sufficiently cured, the prestressing members can be released from the mold and the tie removed. In such an operation where a large number of ties are to be produced economically, a substantial number of molds are required. The requirement for a large number of molds results from the need, under present systems, to retain the prestressing tendons tensioned in the mold until sufficient strength is exhibited by the concrete to retain them in a tensioned condition.

Efforts have been made, including accelerated curing cycles, generally carried out in boxes or tunnels heated with steam, to improve the molding cycle. Notwithstanding such efforts, generally molds employed in such processes cannot be cycled more than once or twice during twenty-four (24) hours. Naturally, capital expenses as well as manufacturing complexities can be reduced with increased mold utility.

SUMMARY OF THE INVENTION

The present invention is directed to a technique and apparatus for reducing the curing time for railroad ties and the like. Consequently, the number of molds employed for a given output may also be reduced. To accomplish the lower curing time, heated uncured concrete is placed in the mold and then cured at a high temperature with the mold securely closed. By employing this procedure, the time required for curing may be reduced by more than one-half.

In comparison to conventional systems where only two cycles per twenty-four (24) hour period have been obtained, the present system allows up to five (5) cycles per mold in twenty-four (24) hours. Naturally, for a given output, the number of molds employed may be reduced by at least fifty percent (50%). For example, a plant producing one thousand two hundred (1,200) ties per day will need at least eight hundred (800) molds using conventional molding techniques. This number may be reduced to three hundred fifty (350) by operating according to the process of the present invention. As the molding elements are very expensive, the reduction of four hundred fifty (450) molds produces remarkable economy in both capital expenditure and running costs. Maintenance of the molds is also reduced.

It has been conventional practice to stack the filled molds in a heated curing environment some two or three hours after the cement has been mixed with water, placed in the mold and vibrated. By the present invention, the molds may be stacked and placed in the accelerated curing, heated environment immediately upon being filled. The stacking is accomplished by placing one mold directly on the next preceding mold such that the upper mold forms a cover to completely seal the curing concrete within the lower mold. Only the top mold requires a cover which will be locked on the mold. The high initial mixing temperature and the closed mold apparatus combine to eliminate the conventional two to three hours of precuring prior to heating. By the present invention, heating may be commenced immediately.

It has also been found that the conditions of the present process yield greater final strength in the cast product. This added strength is necessary for certain applications. Alternately, a less expensive cement may be employed to obtain the normal strength of traditionally cast ties.

One-piece conical locking members are disclosed which can be used to tension the tendons in the mold. These members are threaded onto each tendon end and drawn through holes in the mold. A nut threaded onto each member is employed to apply tension. Means for gaining purchase on the outer end of each member to torque the member free from the concrete is also provided.

Accordingly, it is an object of the present invention to provide an improved process for casting prestressed concrete.

It is another object of the present invention to provide improved molding apparatus for the molding of prestressed concrete.

Other and further objects and advantages will appear hereinafter.

DETAILED DESCRIPTION OF THE PREFERRED EMBODIMENT

Figure 1:
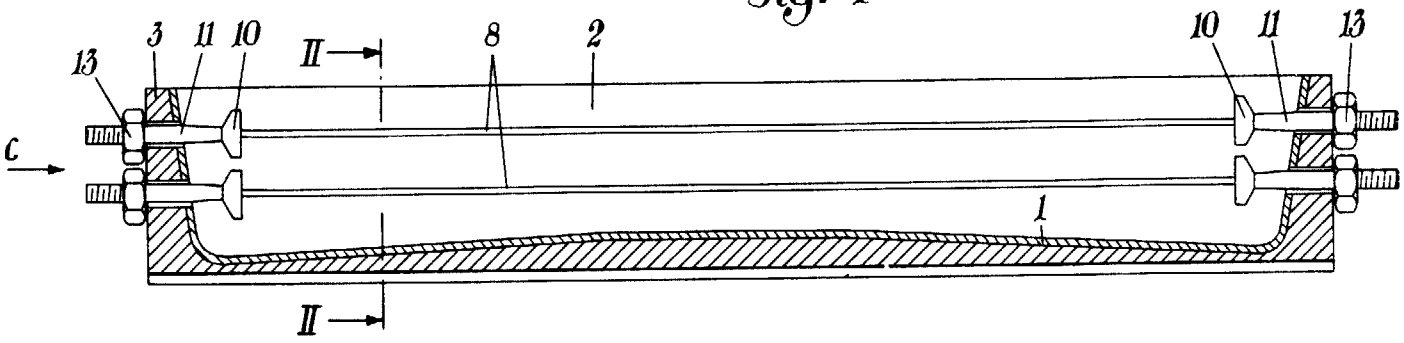
FIG. 1 is a longitudinal sectional view of the mold for carrying out the process according to present invention, taken along the plane I—I of FIG. 2.
Figure 3:
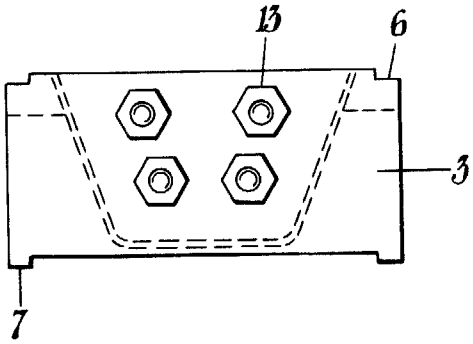
FIG. 3 is a elevational view taken along the direction of Arrow C of FIG. 1.
Figure 2:
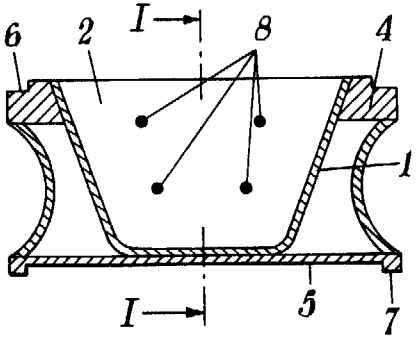
FIG. 2 is a sectional view along the plane II—II of FIG. 1.

With reference to FIGS. 1 through 3, the mold comprises an internal jacket 1 made of metallic material or other suitable molding structure. The internal jacket is shaped to define a mold cavity according to that which is to be imparted to the tie. It is within jacket 1 that the concrete casting 2 is to be formed. The jacket 1 is contained within a rigid structure comprising the heads 3, the top frame 4 and the bottoms 5.

The top frame 4 is provided with an edge-groove 6 and the bottom 5 is provided with a ridge 7. The edge-groove 6 and the ridge 7 are complementary so that the molds can be stacked by superposition such that each succeeding mold will serve the function of covering the underlying mold.

Inside the casting recess 2, four pretensioning tendons 8 are arranged. The tendons 8 are somewhat shorter than the tie to be formed according to conventional practice. The size of the tendons are determined by conventional stress analysis and the actual number of tendons may also be varied.

Figure 4:
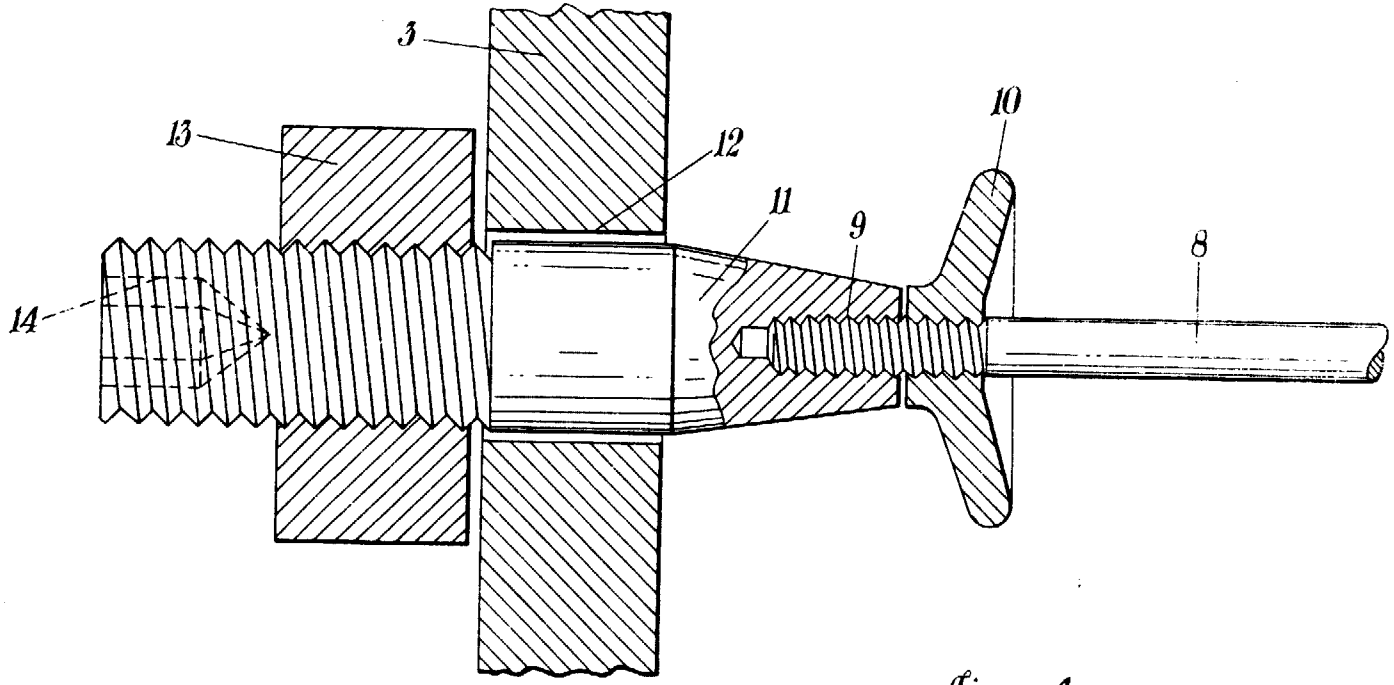
FIG. 4 shows a detail, in enlarged scale, of the anchoring of the prestressed bars.

The tendons 8 (seen also in FIG. 4) include a threaded zone 9 at each end. A washer or circular plate 10 is threaded thereon to serve to better distribute the tension load within the concrete following release of the tendons 8 from the mold. A conical locking member 11 is also threaded onto zone 9 for tensioning of the tendon 8. The conical locking member 11 extends through holes 12 provided in the heads 3 of the mold. A nut 13 is then threaded onto the outer end of the conical locking member 11 to exert tension on the conical locking 11 member and in turn the associated tendon 8.

With the foregoing apparatus, prestressed concrete railroad ties may be cast by heating the water and the cement to a temperature around 80° C.-90° C. The concrete mixture is then poured into the mold, commonly with vibration to assure proper material deposition. Once the concrete material has been poured, the molds are stacked to tightly close the mold cavities as can best be seen in FIG. 5. So oriented, the molds are then positioned in a room maintained at a temperature of around 60° C.-80° C. for approximately three or four hours. Following this curing period, the nuts 13 are unscrewed sufficiently to be released from the mold. Means for gaining purchase on the member 11 to forcefully torque the member 11 free from the cured concrete and the mold is also provided. To this end, a head key may then be employed to act on seat 14 to break away the conical locking member 11 and unthread it from the assembly. With proper curing according to the present invention, the removal of the nuts 13 and the conical locking member 11, the prestress in the tendons 8 will be transferred from the mold to the tie.

Figure 5:
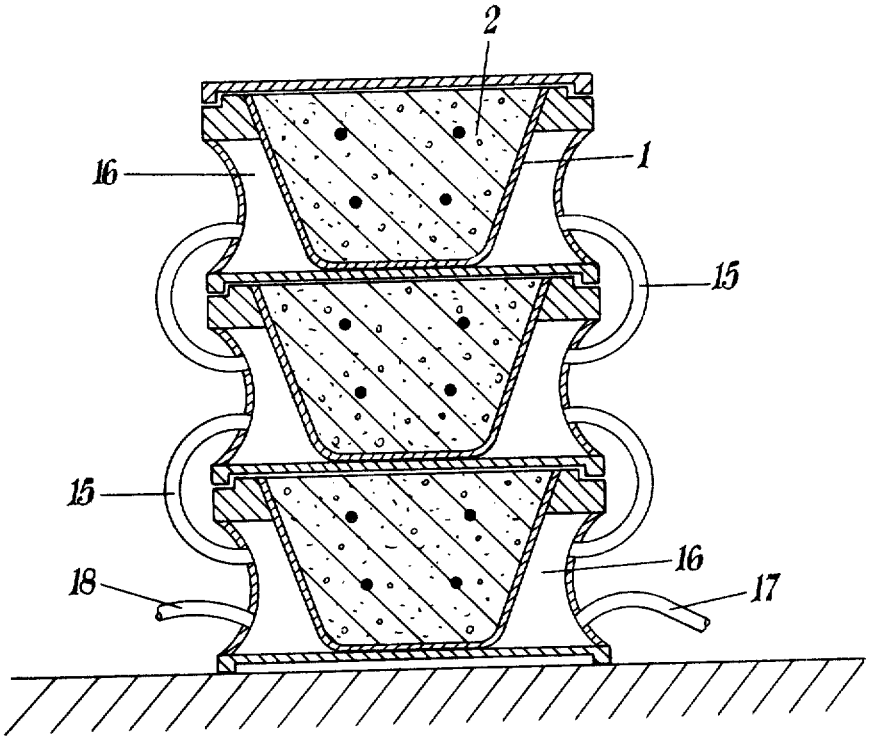
FIG. 5 shows a stack of molds during the curing stage of the concrete casting.

In an alternate embodiment, curing heat may be supplied as best seen in FIG. 5 by employing tubes 15 to connect cavities 16 provided on the molds. Heating steam may be supplied through inlet 17 while exhausted steam and condensate may be removed from outlet 18. In this way, a heated cavity of sufficient size to accomodate a large number of castings may be avoided.

Thus, a process and the apparatus for carrying out the process are set forth for the precasting of concrete ties and the like where a large number of castings may be made from a limited number of molds through increased mold efficiency. Furthermore, higher quality castings may be achieved by the present invention. While embodiments and applications of this invention have been shown and described, it would be apparent to those skilled in the art that many more modifications are possible without departing from the inventive concepts herein described. The invention, therefore, is not to be restricted except by the spirit of the appended claims.

What is claimed is:

1. A process for manufacturing prestressed concrete items, including the steps of pretensioning tendons in a mold, pouring concrete into the mold, placing the mold with concrete therein in a controlled environment having a temperature of between about 60° C. to 80° C. until the concrete is sufficiently cured to support the pretensioned load in the tendons, releasing the tendons from the mold and removing the cast concrete from the mold wherein the improvement comprises heating the concrete prior to said step of pouring the concrete into the mold, sealing the mold substantially immediately after the step of pouring the concrete into the mold and heating the mold substantially immediately after the step of pouring the concrete into the mold.

2. A process for manufacturing prestressed concrete items, comprising the steps of pretensioning tendons in a mold, heating concrete to a temperature of between about 80° C. to 90° C., pouring the heating concrete into the mold, substantially immediately sealing the mold after pouring the concrete into the mold, placing the mold with concrete therein substantially immediately after pouring the concrete into the mold in a controlled environment having a temperature of around about 60° C. to 80° C. until the concrete is sufficiently cured to hold the pretensioning in the tendons, releasing the tendons from the mold and removing the cast concrete from the mold.

* * * * *